United States Patent [19]

Scharlin

[11] 4,073,510

[45] Feb. 14, 1978

[54] LARGE PRINT BOOKS AND METHOD FOR PRODUCING THE SAME FROM REGULAR SIZE BOOKS

[76] Inventor: John A. Scharlin, 510 E. Andover Drive, Burbank, Calif. 91504

[21] Appl. No.: 613,620

[22] Filed: Sept. 15, 1975

[51] Int. Cl.[2] ..... B42C 1/00

[52] U.S. Cl. ..... 281/15 R; 11/1 R; 270/1; 281/38; 283/63 R

[58] Field of Search ..... 270/1; 355/77, 40, 52; 35/35 A, 35 E; 283/63 R; 11/1 R; 281/15 R, 38

[56] References Cited

U.S. PATENT DOCUMENTS 1,009,687 11/1911 Patton ..... 283/63 R X

*Primary Examiner*—Jerome Schnall
*Attorney, Agent, or Firm*—Subkow and Kriegel

[57] ABSTRACT

An enlarged print book is produced by microfilming the front and back pages of each sheet of an original book, printing each of such pages from the microfilm at a desired page size, severing each printed page approximately in half, arranging the bottom half of one page above the top half of a succeeding page with the severed upper end or trim line of the bottom half a predetermined distance above the severed lower end or trim line of the top of the succeeding page, microfilming such arrangement on a single film frame, enlarging the single frame to a predetermined extent to produce a single enlarged sheet having the bottom half at its top and top half at its bottom, trimming the top and bottom halves at exactly their respective upper and lower trim lines, folding each enlarged sheet precisely midway between their trim lines with the printed sides of the bottom and top halves exposed, producing each succeeding enlarged sheet from the original book in the above manner, and binding successive enlarged sheets together at their trim lines to produce a finished book, whereby opening of the book will expose the enlarged top half of a page of the original book above the enlarged bottom half of the same page of the original book.

7 Claims, 12 Drawing Figures

Figure 4:
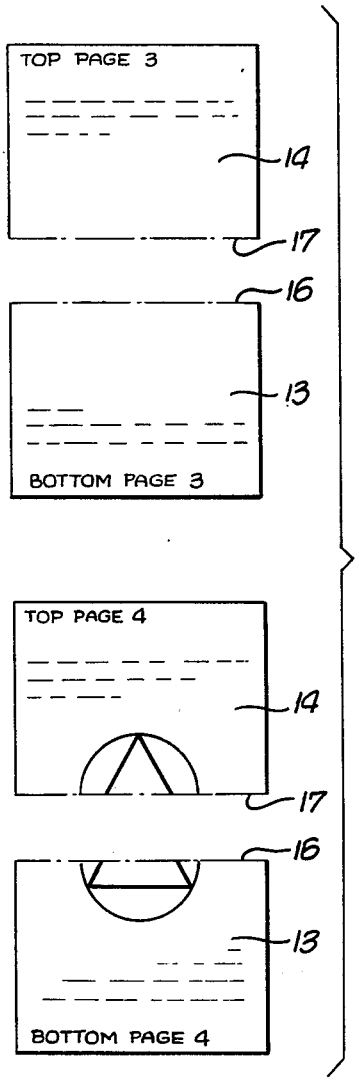

FIG. 1.
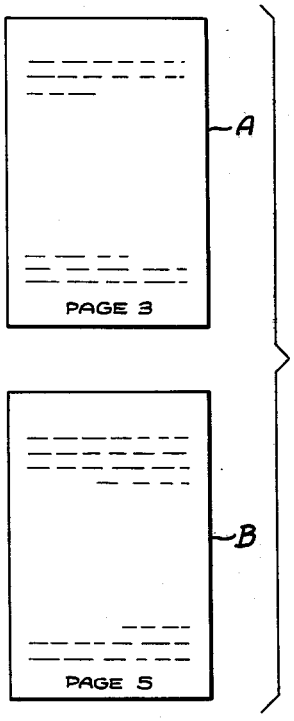
FIG. 2.
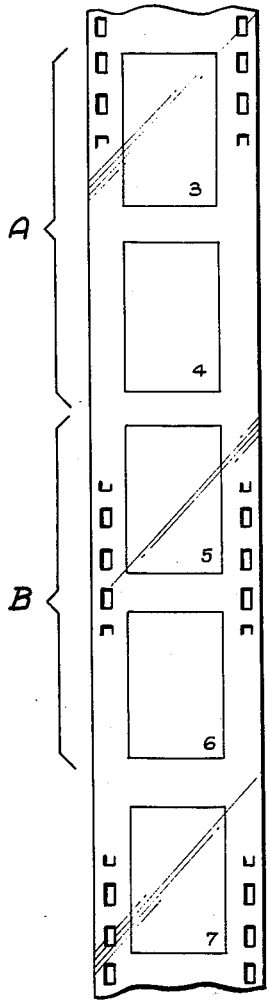
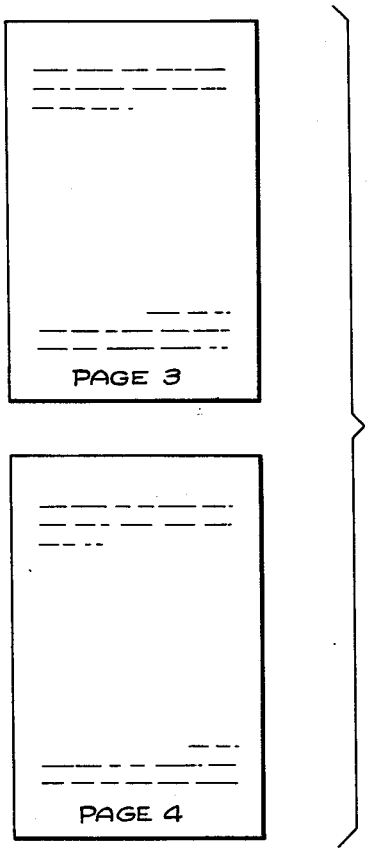
FIG. 3.

LARGE PRINT BOOKS AND METHOD FOR PRODUCING THE SAME FROM REGULAR SIZE BOOKS

The present invention relates to printed matter, and more particularly to enlarged print books made from original or smaller size books, and to methods for producing such enlarged print books.

Large print books are made for individuals who are classified as "legally blind". Such individuals may have only 10% or less of normal vision in only one eye. Average type sizes of 6 pt to 12 pt are very difficult or impossible for them to read. However, since these people are not completely blind, they can be educated with regular schooling in normal classrooms to be self-supporting, provided textbooks and other printed matter can be enlarged sufficiently for them to read.

Enlarged single-copy books, as opposed to multi-copy, standard ink-printing books, having large type sizes are necessitated by the fact that usually one person, such as a student, may be taking a certain course in a school which requires a textbook that may never be required by another visually impaired individual in the entire country. Currently, single-copy, large print books have been produced as a result of microfilming the original smaller size book page by page-by-page, and then enlarging the film frames on a suitable machine, such as a xerographic machine, of a known type. Essentially, the large print book is a standard xerographic copy obtained through use of a microfilm negative and a specialized xerographic or Xerox Copyflo printer to achieve the required enlargement.

Enlarged print books are usually of from 11 × 15 inches to 11 × 17 inches in page size. These oversized print books result from the process of enlarging the type from the original book by 150% to 300%, which also obviously enlarges the entire page size of the original book. The special problem created by this technique is not only the physical difficulty by a blind person, or anyone else, handling a very large book, but, more importantly, almost all of the visually handicapped persons share a strong psychological aversion to being considered "different". They often will not read at all, rather than carry around an oversized book. It, therefore, becomes very important to the education of these handicapped individuals to make their reading material appear outwardly as normal and conventional as possible.

A prior enlarged print book has been made which involves the microfilming of the top and bottom halves of each page, enlarging each half, glueing the bottom half of one page to the top half of the next succeeding page in back-to-back relation, and then binding the glued pages together. When the book is opened, the original top half of a page of the original book has the bottom half of the same page of the original book immediately below it, permitting the enlarged top and bottom halves of the same page to be read in the same manner as in the original book. With the glue technique, large print books can be made of substantially the same size, when closed, as the original work.

In the production of large print books embodying the glueing technique, difficulties are encountered. The enlarged top and bottom halves must be physically glued together, and this glueing step must be performed for every copy produced. The book is subject to deterioration of the glue, inadequate control over illustrations, charts and other continuous image formats, and presents considerable problems with two or three column book formats in which the open space between the lines of type do not align with one another. All of the above individual steps of half page production and glueing must be repeated each and every time a copy of any book is produced.

Through use of applicant's method, large print books can be produced without having an oversized format; that is, books up to 11 × 17 inches in size. Applicant's method enlarges the top and bottom half of each page of the original book to normal book page size, which may range from 6 × 8 inches to 8½ × 11 inches. Yet the original full-page format of the original book is preserved when the large print book is opened for reading. Basically, enlarged prints of the bottom one-half of one page and the top one-half of the following page are printed on a single sheet of paper. The resulting page is folded in half, which is true of all following pages, which are then bound together at their open ends. When the book is opened, the original full page reads continuously from top to bottom of the large print book, or in the same manner as the same page is read from the original print book. Not only is the text read continuously from top to bottom, but illustrations and figures continue from each half page to the next half page, with such illustrations and figures closely adjacent or contiguous one another and in proper alignment. The present method provides a book which gives the appearance of two-sided printing without completely reforming the book. It results in a book that is normal looking in overall size when in a closed condition.

Additional copies are easily produced once the microfilm of the bottom half of one page above the top half of the following page has been created. Additional copies can be produced easily from such microfilm since it is only necessary to print each composite sheet to the desired size from the microfilm frames, trim the top and bottom edges, fold each sheet in half, and then bind all the sheets so formed in successive order. Individual glueing of half pages, as in the prior art design, is not required.

This invention possesses many other advantages and has other purposes which may be made more clearly apparent from a consideration of a form and method embodying the invention. This form and method are shown and described in the present specification and in the drawings accompanying and constituting a part thereof. They will now be described in detail, for the purpose of illustrating the general principles of the invention; but it is to be understood that such detailed description is not to be taken in a limiting sense.

Figure 12:
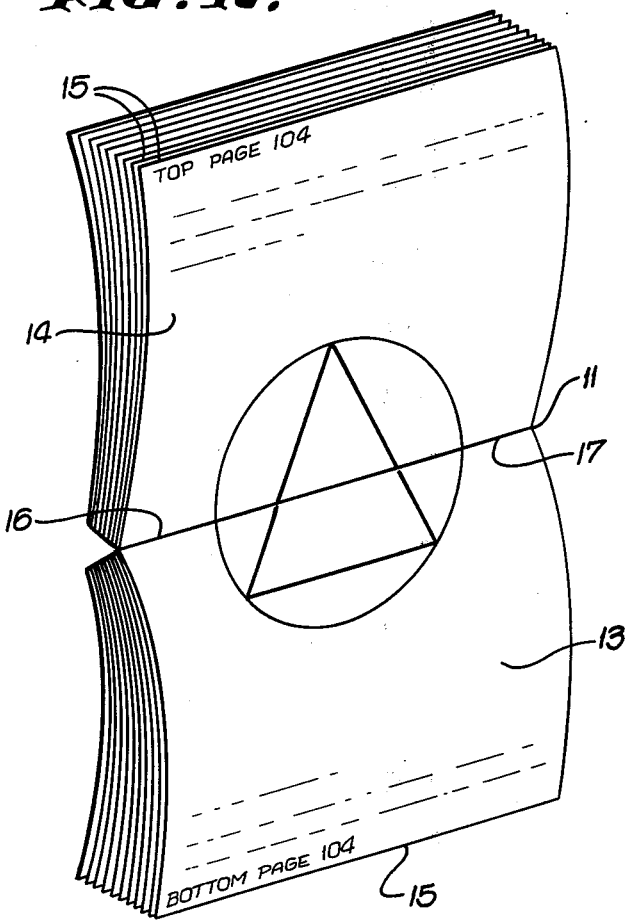
Figure 11:
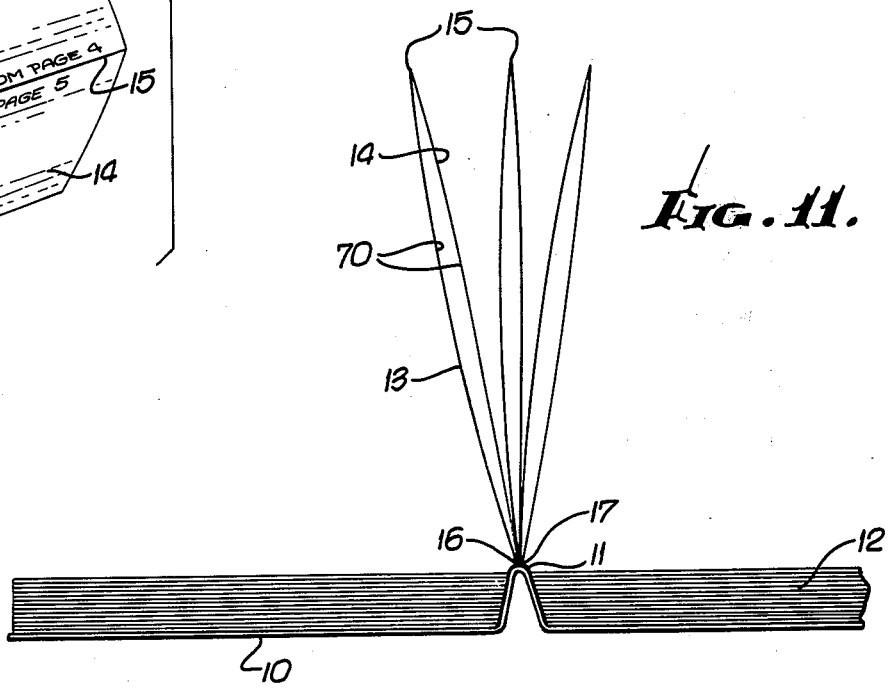

Referring to the drawings:

FIGS. 1 to 10, inclusive, illustrate successive steps of producing large print books;

FIG. 11 is an end view of an opened bound book embodying applicant's invention, with some of the sheets shown separated from one another, and with the top and bottom portions of each of such sheets spaced from one another for purpose of illustration; and FIG. 12 is an isometric view of the finished book in an open condition.

A large print book is illustrated in FIGS. 11 and 12, which is produced by following the steps disclosed in FIGS. 1 to 10, inclusive. The book itself includes a cover 10 having a central binding 11 to which composite sheets 12 are glued, or otherwise secured. Each sheet is derived from a regular book, consisting of the bottom half 13 of a page of the book and the top half 14 of the next succeeding page of the book, these two half pages being folded over at their fold line 15 and with the free ends 16, 17 of the sheet glued or otherwise secured to the book binding 11. When the book is opened, as, for example, to page 104 (FIG. 12), the top half 14 of page 104 will appear on the upper sheet above the binding 11; whereas, the bottom half 13 of page 104 will be present on the lower sheet below the binding. The top and bottom together are an enlarged duplicate of page 104 of the original or regular book from which the composite book is made.

Each sheet, comprising the bottom half 13 of one page and the top half 14 of the succeeding page, will have its free ends 16, 17 glued or otherwise secured to the binding 11. The fold line 15 will be the outer edge of the composite sheet 13, 14, all of the fold lines being uniformly spaced from the binding so as to give the book a regular appearance when closed, the free ends 17, 16 of the top 14 and bottom 13 of the same number page being contiguous at the binding 11 and closely adjacent one another so as to give the same appearance as a continuous page, corresponding to the same numbered page of the regular book from which the enlarged book has been made.

In producing the large print book illustrated in FIGS. 11 and 12 from a regular size book, the regular size sheets are cut loose from the original binding. Two severed sheets A and B are disclosed in FIG. 1, by way of example, representing page 3 of one sheet A and page 5 of the next sheet B. The reverse sides of the sheets will be pages 4 and 6, respectively. Both sides of each sheet are then microfilmed as illustrated in FIG. 2. Thus, the first frame 3 representing a side of sheet A appears on the microfilm, which may be 35mm film, page 4 of sheet A then being filmed as page 4, which is followed by a side of sheet B which will be frame 5 of page 5, and the reverse side of sheet B which is frame 6 of page 6. Microfilm frames 7, etc. of both sides or pages of each succeeding severed book sheet are then made.

A print of each page 3, 4, 5, 6, etc. is made from the frames to the desired extent, which may, by way of example, be about 125% of the size of the original book page, separate pages 3 and 4 being represented, by way of example, on FIG. 3 as being enlarged, single-sided copies of each sheet, such as sheet A. The reverse side of each of such enlarged copies of the pages is blank.

Each enlarged single-sided copy is then cut approximately in half, as disclosed in FIG. 4, to provide the free ends 17, 16, corresponding to the ends 17, 16 of FIG. 12. Each cut is made between lines of type or text so that a printed line is not severed. Illustrations, diagrams, and the like, may be severed by the cut, as disclosed in the representation of page 3 on FIG. 4. The severing of each page produces a top half and a bottom half of each page, as illustrated in FIG. 4.

Figure 5:
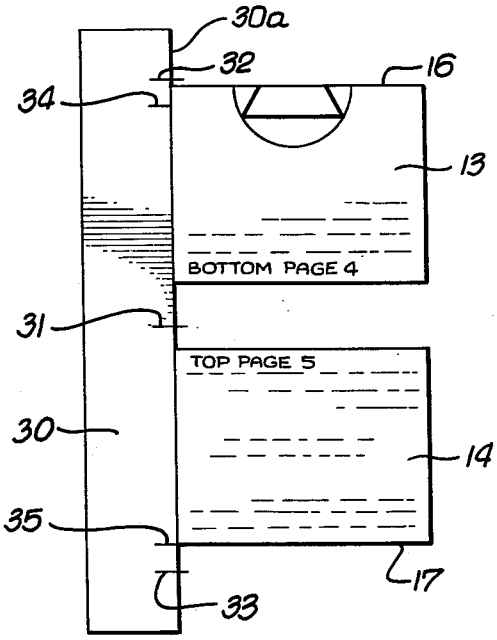

The bottom of each severed page, such as page 4, is then placed on a suitable jig, such as against a straight edge 30, and the top of the next severed page, such as page 5, is also placed against the straight edge 30 below the bottom of the preceding page, as illustrated in FIG. 5, with the top edge 16 of the bottom page 4 being disposed a predetermined distance from the bottom edge 17 of the top portion of the next succeeding page 5.

As disclosed in FIG. 5, the straight edge 30 has a fold line mark 31 and upper and lower marks 32, 33 spaced equal distances from the fold mark 31. Another mark 34 is disposed a short distance below the upper edge mark 32; whereas, another lower edge mark 35 is disposed a short distance above the lower edge mark 33. The alternative upper marks 32 or 34 and 33 or 35 are used as reference points for the free ends 16, 17 of the page. If, for example, a diagram, figure or picture has been severed in making the cut which provides the free ends 16, 17, such as shown in FIG. 5, the free end 16 will be placed slightly below the upper mark 32, in order to secure close juxtaposition or contiguity between the bottom of the severed figure, as illustrated in FIG. 5, and the top of the same figure, which appears on the top of page 4, when the free ends or edges are bound in the finished book, such as illustrated in FIG. 12. On the other hand, if the cut of a severed page into its top and bottom halves has been made to one side of a line of type, that is, between lines of type, to insure that a line of type is not severed, and that the cut is not too close to the line of type, the free end, such as the free end depicted by 17 of the top of page 5 in FIG. 5, is preferably placed to one side of, as above, the outermost reference mark 33, and preferably no higher than the alternate reference mark 35. The binding of this free end 17 in the book might leave a gap between the top of the page and the bottom of the same page, when the book is opened, but such gap is not material nor disturbing to the person viewing the opened book. However, a gap might be material in the case of the severed diagram disclosed in FIG. 4.

The jig has its outermost 32, 33 and its fold line mark 31 extend inwardly from the edge **30*a* of the straight edge to a slight extent. Accordingly, when the composite of the bottom half of one page and the top half of the next succeeding page, as mounted on the jig (FIG. 5), is microfilmed, the bottom half of one page appears on the same frame as the top half of the following page, as disclosed in FIG. 6. The innermost portions of the topmost and bottommost marks 32, 33, and the innermost portion of the fold line mark 31, will appear on the frame since such innermost portions extend inwardly to a slight extent beyond the edge 30*a* of the straight edge against which the bottom half and top half of the pages bear. Thus, the mark 32 of FIG. 5 will appear as a slight mark substantially at the free end or trim line 16. The inner portion of the bottommost reference mark 33 will appear in the frame slightly below the free end 17 of the top of page 5 (FIG. 5). The innermost portion of the fold line 31** will appear on the frame between the upper located bottom half of the page and the upper end of the top of the next succeeding page.

Figure 6:
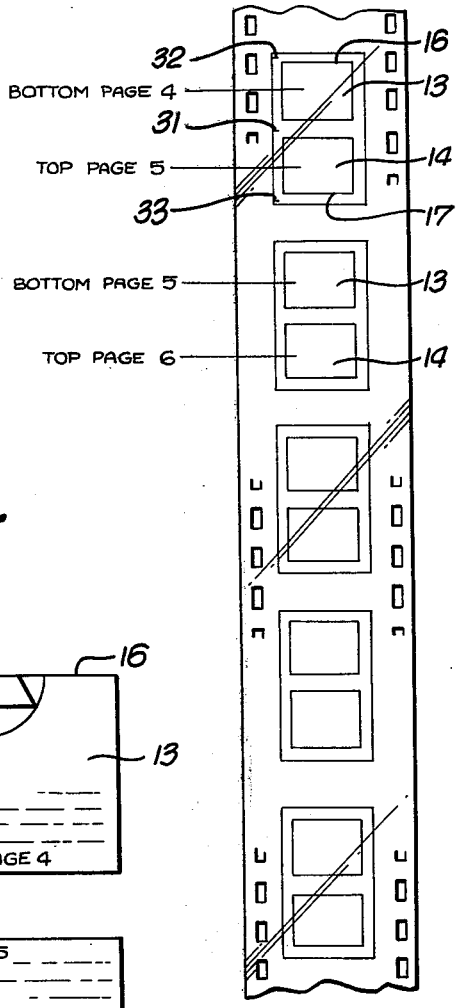

The arrangement of the bottom of each page and the top of the succeeding page in the jig and its microfilming is performed for all composite sheets, in the manner illustrated in FIG. 5, FIG. 6 disclosing the several frames of succeeding composites of the bottom of one page and the top of the next page.

Figure 7:
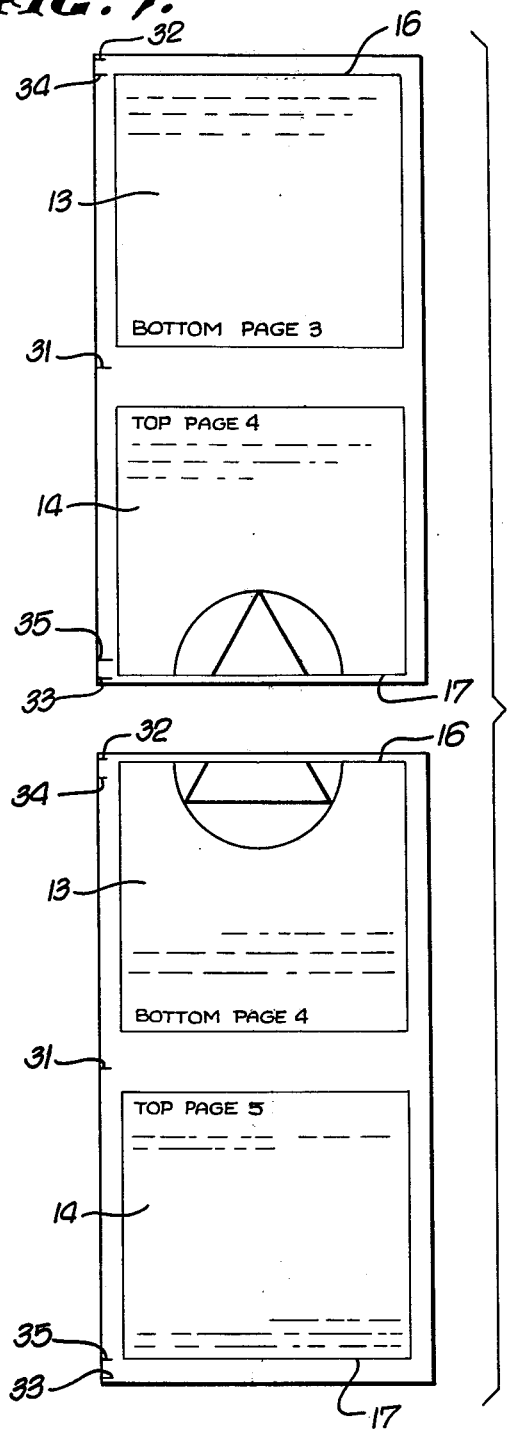
Figure 8:
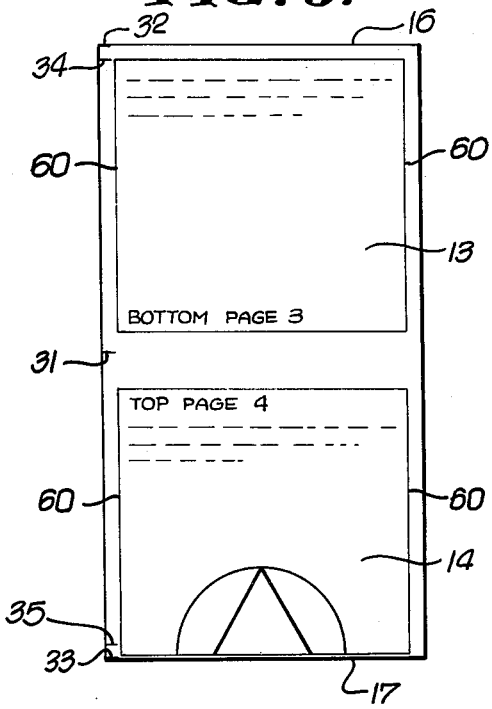
Figure 9:
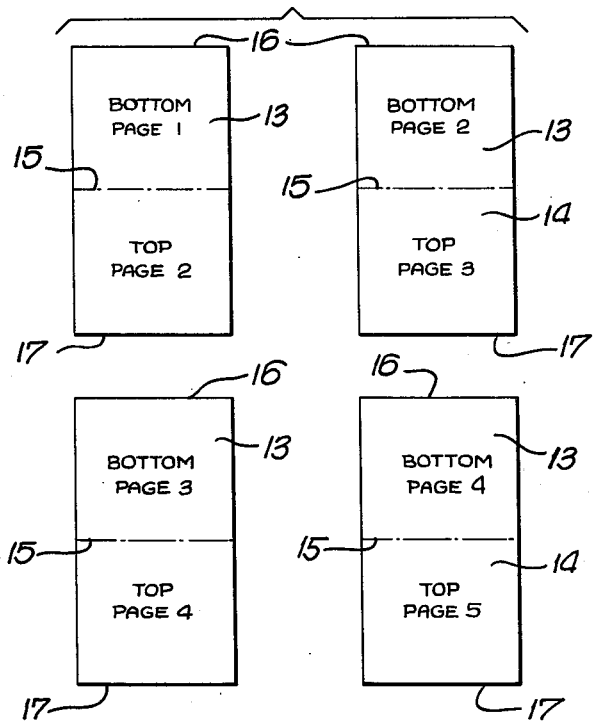
Figure 10:
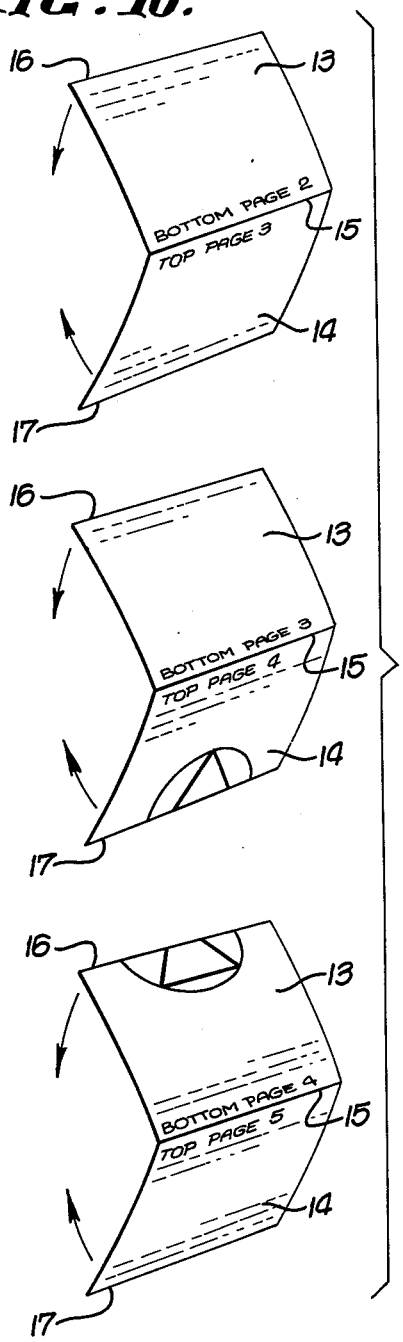

Each film frame is then enlarged to the required size, as disclosed in FIG. 7, which, by way of example, may be an enlargement to about 200% of the original or regular page of the print book from which the copy of the book is being made. One of the enlarged prints shown in FIG. 7 discloses the bottom half of page 3 above the top half of page 4, with the upper end 16 of the bottom half between the upper marks 32, 34, the lower mark 33 being substantially in alignment with the free end 17 of the top of page 4, the fold line mark 31 being printed at the appropriate place between the bottom and top of pages 3 and 4, respectively. The upper end of each sheet is then severed along a line including the upper reference mark 32 on the sheet and along the line corresponding to the lower reference mark 33, the fold line 31 being exactly midway between the severed upper and lower edges of the composite sheet, as disclosed in FIG. 8. The side margins of each sheet can then be trimmed at desired places, such as at 60, to determine the width of the sheet. Each sheet is then folded along its central fold line 15, determined by the reference mark 31, as illustrated in FIG. 9, the blank sides 70 of each sheet being folded against one another with the printed sides 13, 14 remaining exposed. The act of folding each sheet is illustrated isometrically in FIG. 10, each sheet being folded exactly in half.

When each sheet is fully folded, the bottom half 13 is disposed on the front side of each folded sheet and the top half 14 on the back side of the same folded sheet.

The open or free edges 16, 17 of the folded sheets are then bound together using an appropriate binding method, such as the LRS Arch-Bound Method, to produce the book illustrated in FIG. 11. Such method glues the free ends of the sheets to the binding, the binding itself permitting the book to be opened with the pages lying substantially flat.

When the book is closed, it may have the size approximating the size of the regular edition of the work, except for its thickness, which will be about twice that of the original book. When the book is opened, the original full page, in which the top half 14 of the page on one sheet is above the bottom half 13 of the page on the next succeeding sheet, reads continuously from top to bottom of the large print book, in the same manner as the original book is read. Not only is the text read in that manner, but illustrations and figures extending from each one-half page 14 to the next one-half page 13 are in near-butt alignment, as illustrated by way of example in FIG. 12. The completed book enables the visually handicapped person to read the text and illustrations in the same manner as a person with normal eyesight can read the original book.

The method is particularly adapted for making a single, enlarged copy from the original book, with the overall size of the book, except for its thickness, being substantially the same size as the original book. In the event it is desired to make an additional copy or copies, the steps illustrated in FIGS. 1 to 5, inclusive, may be omitted, and the microfilm of FIG. 6, in which each frame is composite of the bottom half of one original page and the top half of the next original page, is used as a starting point to produce the enlarged size composite pages disclosed in FIG. 7, followed by the trimming, folding and binding steps illustrated in FIGS. 8 to 10, inclusive.

The enlarged pages disclosed in FIG. 3 are not essential to the practice of the method, since any enlargement can be used or, for that matter, the pages from each side of the sheets disclosed in FIG. 1 can be reproduced to the same size as disclosed in FIG. 1. However, it is more convenient in effecting the severing step and the proper assembly of the bottom of one page and the top of the next succeeding page to produce the enlarged prints disclosed in FIG. 3 before the severing and jig assembly steps are effected.

By virtue of the method and the book disclosed, the book produced is of substantially the same size when folded as the present book, but with the material on each page enlarged to the desired extent, rendering it properly and functionally visible to an individual who may be classed as "legally blind", but who has sufficient vision to permit the reading of the enlarged type sizes and figures of the large print book. The half pages of each folded over sheet produced by applicant's technique enables the finished book to be produced in much less time and with greater accuracy than prior methods, such as the one in which the half pages are individually and physically glued to one another, this glueing step being required for every enlarged copy produced.

I claim:

1. A method of producing a large print size book from a book originally of smaller print size, comprising separating the original book pages from the book, making a copy of each side of each book page on an individual first sheet, severing each sheet approximately in half to produce a top half and a bottom half of each sheet, placing the bottom half of each sheet above the top half of the next succeeding sheet with the bottom and top halves arranged in a predetermined relation to each other, making an enlarged copy on a single second sheet of each combination of bottom and top halves arranged in such predetermined relation, folding each second sheet in half to provide an outer folded edge of each enlarged copy and inner free edges, and binding said free edges of said second sheets together.

2. A method as defined in claim 1; microfilming both sides of said original book pages, making said copy of each side of each page of said first sheet from said microfilm, microfilming each combination of bottom and top halves, and making said enlarged copy of said second sheet from said microfilm of said combination of bottom and top halves.

3. A method as defined in claim 1; providing said free edges by trimming the upper end of said bottom half and the lower end of said top half to the extent that said upper end is contiguous the lower end of the top half of the next preceding sheet and said lower end is contiguous the upper end of the bottom half of said next succeeding sheet when said free edges are bound together.

4. A method as defined in claim 1; providing said free edges by trimming the upper end of said bottom half and the lower end of said top half to the extent that said upper end is contiguous the lower end of the top half of the next preceding sheet and said lower end is contiguous the upper end of the bottom half of said next succeeding sheet when said free edges are bound together, microfilming both sides of said original book pages, making said copy of each side of each page on said first sheet from said microfilm, microfilming each combination of bottom and top halves, and making said enlarged copy of said second sheet from said microfilm of said combination of bottom and top halves.

5. A method of producing a large print size book from a book originally of smaller print size, comprising providing a specimen of the top half of each side of each book page and a specimen of the bottom half of the same side of each book page, placing the specimen of the bottom half of each book page above the specimen of the top half of the next succeeding page with the bottom and top halves arranged in a predetermined relation to each other, making an enlarged copy on a one-piece sheet of each combination of bottom and top half specimens arranged in such predetermined relation, folding each sheet in half to provide an outer folded edge of each enlarged sheet and inner free edges, and binding said free edges of said sheets together.

6. A method as defined in claim 5; microfilming each combination of top and bottom half specimens, and making each of said enlarged copies from said microfilm of said combination of top and bottom half specimens.

7. A method as defined in claim 5; providing said free edges by trimming the upper end of said bottom half of said enlargement and lower end of said top half of said enlargement to the extent that said upper end is contiguous the lower end of the top half of the next preceding page and said lower end is contiguous the upper end of the bottom half of said next succeeding page when said free edges are bound together.

* * * * *